US006726090B1

(12) United States Patent
Kargel

(10) Patent No.: US 6,726,090 B1
(45) Date of Patent: Apr. 27, 2004

(54) METHOD AND SYSTEM OF VOTING

(76) Inventor: David Kargel, 16829 Ennis Rd., Athens, AL (US) 35613

( * ) Notice: Subject to any disclaimer, the term of this patent is extended or adjusted under 35 U.S.C. 154(b) by 216 days.

(21) Appl. No.: 09/860,900

(22) Filed: May 18, 2001

(51) Int. Cl.[7] ..... G07C 13/00
(52) U.S. Cl. ..... 235/51; 235/50 A
(58) Field of Search ..... 235/51, 50 R, 235/50 A, 50 B, 54 A, 54 B, 54 C, 54 D, 54 E, 54 F, 56, 55 E, 55 A, 55 C, 52, 53; 705/12

(56) References Cited

U.S. PATENT DOCUMENTS

| | | | | | |
|---|---|---|---|---|---|
| 3,677,453 | A | | 7/1972 | Parks | 225/93 |
| 3,708,656 | A | | 1/1973 | Fielder | 283/5 |
| 3,944,788 | A | | 3/1976 | Comisar | 235/54 |
| 4,236,066 | A | | 11/1980 | Olmstead | 235/51 |
| 4,373,134 | A | | 2/1983 | Grace | 235/386 |
| 4,485,298 | A | | 11/1984 | Stephens | 235/50 |
| 4,488,034 | A | | 12/1984 | Stephens | 235/50 |
| 4,717,177 | A | | 1/1988 | Boram | 283/5 |
| 4,774,665 | A | * | 9/1988 | Webb | 705/12 |
| 4,813,708 | A | | 3/1989 | Narey | 283/5 |
| 5,206,486 | A | | 4/1993 | Stephens | 235/51 |
| 5,213,373 | A | | 5/1993 | Ramos | 283/5 |
| 5,260,550 | A | | 11/1993 | Rapp | 235/50 |
| 5,362,104 | A | | 11/1994 | Rapp | 283/5 |
| 5,612,871 | A | | 3/1997 | Skogmo | 395/212 |
| 5,764,221 | A | | 6/1998 | Willard | 345/173 |
| 6,081,793 | A | * | 6/2000 | Challener et al. | 705/50 |
| 6,250,548 | B1 | * | 6/2001 | McClure et al. | 235/51 |
| 6,457,643 | B1 | * | 10/2002 | Way | 235/462.01 |

OTHER PUBLICATIONS

Ruling of N. Sanders Sauls in Albert Gore, et al. vs. Catherine Harris et al, Florida Case No. CV 00–2808, rendered 12/3/0 found on internet @ quarterly–report.com.*

* cited by examiner

*Primary Examiner*—Karl D. Frech
(74) *Attorney, Agent, or Firm*—Stites & Harbison, PLLC; David W. Nagle, Jr.; Mandy V. Wilson

(57) ABSTRACT

A method for conducting an election among a plurality of voters includes the steps of: providing each voter with a ballot having at least one unique identifying symbol and a section for authenticating a voting selection; retaining a record of each voting selection; publishing the record of each voting selection; validating the published record of each voting selection; tabulating the voting selections from the validated record; and certifying the tabulated voting selections.

15 Claims, 7 Drawing Sheets

METHOD AND SYSTEM OF VOTING

A portion of the disclosure of this patent document contains material which is subject to copyright protection. The copyright owner has no objection to the facsimile reproduction by anyone of the patent document or the patent disclosure, as it appears in the Patent and Trademark office patent file or records, but otherwise reserves all copyright rights whatsoever.

BACKGROUND OF THE INVENTION

Elections are intended to provide each voter an equal vote on an issue. In fact, providing such an equal vote is fundamental to a fair election. Important benefits of fair elections are increased voter confidence and sense of enfranchisement in society and in government. In order to realize these benefits, voters must have confidence that the election system faithfully and completely provides the intended equality of each vote cast.

Election systems requiring public voting and tabulation, such as traditional viva voce votes and all votes in the U.S. Congress, give voters the ability to completely verify that the election system provides the intended equality of each vote cast on an issue. These election systems, however, do not provide the level of voter privacy required in modern elections.

As a result of the 2000 U.S. presidential election, however, many voters have lost confidence in the ability of the U.S. election system to faithfully and completely provide the intended equality of each vote cast. The U.S. election system provided results with an accuracy level that will never be known and may never be completely accepted as accurate.

The controversy revealed an election system composed of non-standard and unreliable election methods, machinery, and human judgement. This was most obviously illustrated as election officials tried several times to manually recount millions of anonymous votes in what proved to be a failed attempt to validate the election results. The startling lack of reliability in the methods and mechanics of the U.S. election system and the inability to verify the voting results have caused many voters to lose confidence in the system, and may be disinclined to vote in future elections.

The primary cause of the above problems is related to the manner of secret voting that is employed in such elections. All election systems that require secret voting and tabulation tend to compromise the voters' ability to completely verify that the election system provides the equality of each vote cast on an issue. In these secret voting systems, the voters only have the ability to verify the equality of each vote if they are able to personally observe each step in the election system including the casting, storage, transportation, handling, recording, and tabulating of the votes.

Another potential problem caused by the currently-employed secret voting systems is a lack of homogeneity among voting systems used in the same election. Different physical embodiments of such systems are known to vary in their ability to approach faithful and complete provision of equality of each vote. Complete homogeneity of systems would require that each voter use the same physical embodiment of the secret voting system to assure the same degree of uncertainty in the equality of each vote.

Even if no problems were experienced in the taking of the vote, the tabulation of all votes cast in a national election is also a source of human error. Secret voting systems currently have no way of regressively assuring the quality of the vote.

Given the enormous benefits to be gained by increasing voter confidence in elections and given the fundamental responsibility of governments to ensure the equal protection of each vote in an election, there exists a crucial unmet need for an election system that provides voters with the ability to vote and then to verify that the election system faithfully and completely provides the intended equality of each vote cast.

What is needed, then, is an election system that ensures that all voters have the ability to vote in a system that not only enables them to vote, but also allows them to privately verify that their votes were properly counted at the time of voting, properly added to the public record after the polling times expire, and properly tabulated from such a verified public record.

SUMMARY OF THE INVENTION

The present invention provides a method and system that standardizes and improves the task of ensuring an accurate vote reception and count. The major components of the method involve providing ballots to a group of voters; recording votes from the group of voters; publishing the votes from the group; validating the published votes on a per-voter basis; tabulating the votes validated; and certifying that the tabulated votes were accurately counted.

Systems are also taught herein for accomplishing these components in several different ways, namely: through the use of a carbonless copy paper ballot; through use of an optical scan-type ballot; and through use of a telephonic voting system. However, the particular systems discussed herein are given merely as illustrations of particular embodiments of the invention.

Other embodiments of the invention are expected to employ differing degrees of automation in providing, recording and publishing ballots, and validating and tabulating votes, and certifying results.

The systems taught and described herein are not intended to limit the application of the method claimed. The method of the invention must involve instrumentalities and combinations having different physical sizes and characteristics to suit the many corresponding physical limitations, abilities, and requirements that bear on a particular elections. As long as the principles of ensuring that all individual voters may privately verify or correct their individual publicly recorded votes and ensuring that the election system provides the intended equality of each vote cast, the spirit of the instant invention will be fulfilled.

Accordingly, it is an object of the present invention to provide a voting method and system that allows one or more voters to completely verify the accurate tabulation of each vote on an issue.

It is a further object of the invention to provide a voting method and system that allows each voter to verify that his or her individual vote on an issue was correctly cast and counted.

It is a further object of the invention to provide each voter with a private primary post-voting record of the voter's vote.

It is a further object of the invention to provide a public secondary post-polling record of all votes cast on an issue.

It is a further object of the invention to provide in a voting method and system the capability for voters to use their private primary records of their cast votes to verify or authorize correction of the secondary public record of all votes cast.

It is a further object of the invention to provide in a voting system the capability for voters to use the verified or corrected public record of all votes cast to verify or authorize correction of the tabulated votes.

It is a further object of the invention to provide vote verification and/or vote correction capabilities in a voting method or system that utilizes any physical means of providing, recording and publishing ballots, and validating and tabulating votes, and certifying results.

In addition to the foregoing, further, objects, features, and advantages of the present invention should become more readily apparent to those skilled in the art upon a reading of the following detailed description in conjunction with the drawings, wherein there are shown and described illustrated embodiments of the invention.

DESCRIPTION OF THE PREFERRED EMBODIMENTS

Figure 1:
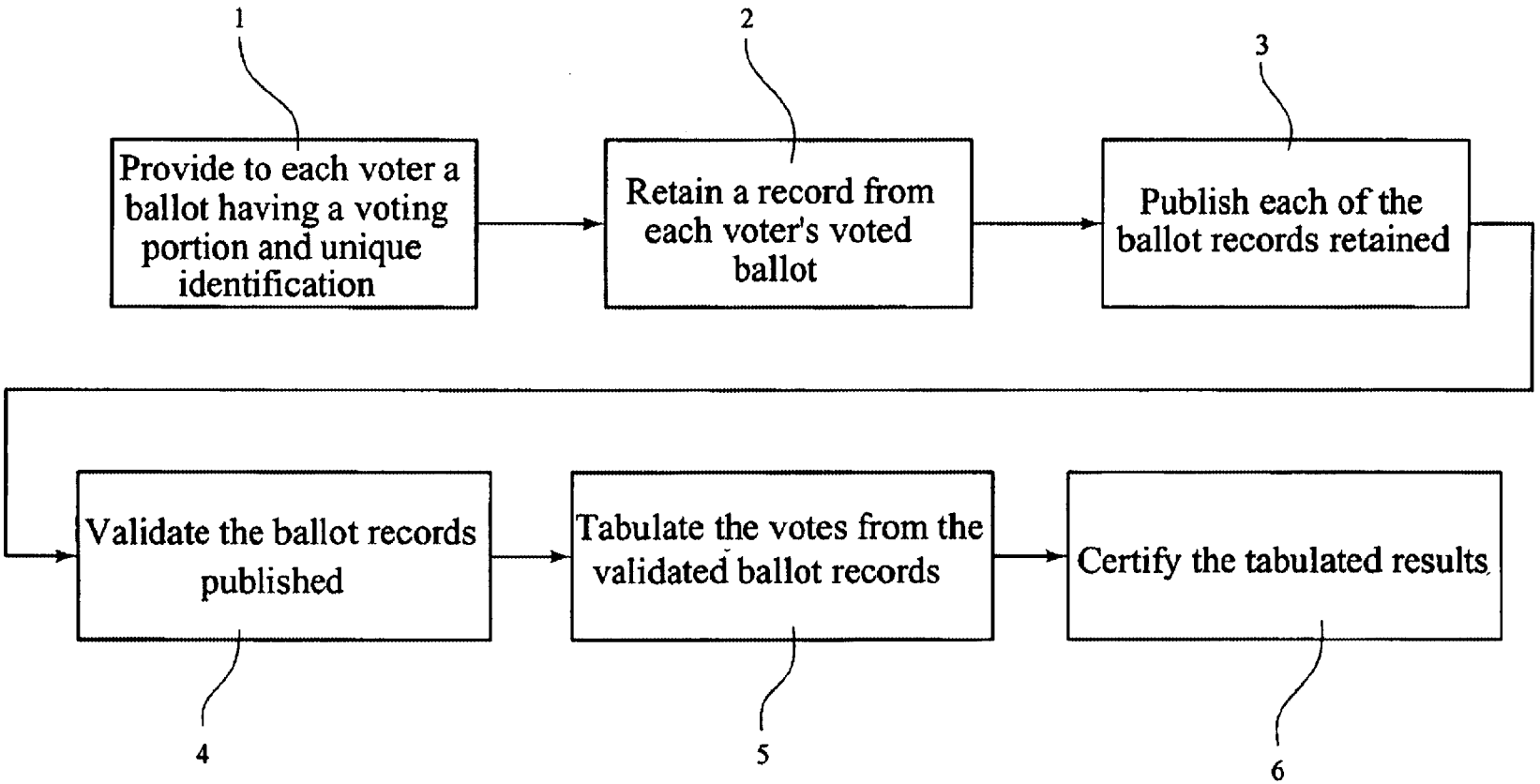
FIG. 1 is a flow diagram of an embodiment of the method of the invention.

Referring to FIG. 1, a basic embodiment of the method of the invention is shown. The method involves six fundamental steps: (1) providing a ballot to each voter 1; (2) retaining a record from each voter's voted ballot 2; (3) publishing a record of each of the ballot records retained 3; (4) validating the ballot records published 4; (5) tabulating the votes from the validated ballot record 5; and (6) certifying the tabulated results 6. The steps in the method may be further expanded as follows.

Step 1—Providing a Ballot to Each Voter

Providing the ballot to the voter may be performed in any of a variety of ways, such as physically handing the ballot to the voter, mailing the ballot to the voter, orally presenting the ballot to the voter over a communications means such as a telephone, or by presenting the ballot to the voter using some transmission and display means as a computer is having an internet connection. Regardless of the method of delivery, the ballot must be communicated to the voter, and the ballot must contain at least a voting portion and a unique identifying portion.

The voting portion is an area of the ballot allowing a voter to indicate a response to the issue to be voted upon. The voting portion may be a blank area for marking a response, a circle or circles to be filled in conjunction with a selection, or an area of the ballot to be punched out.

Figure 2:
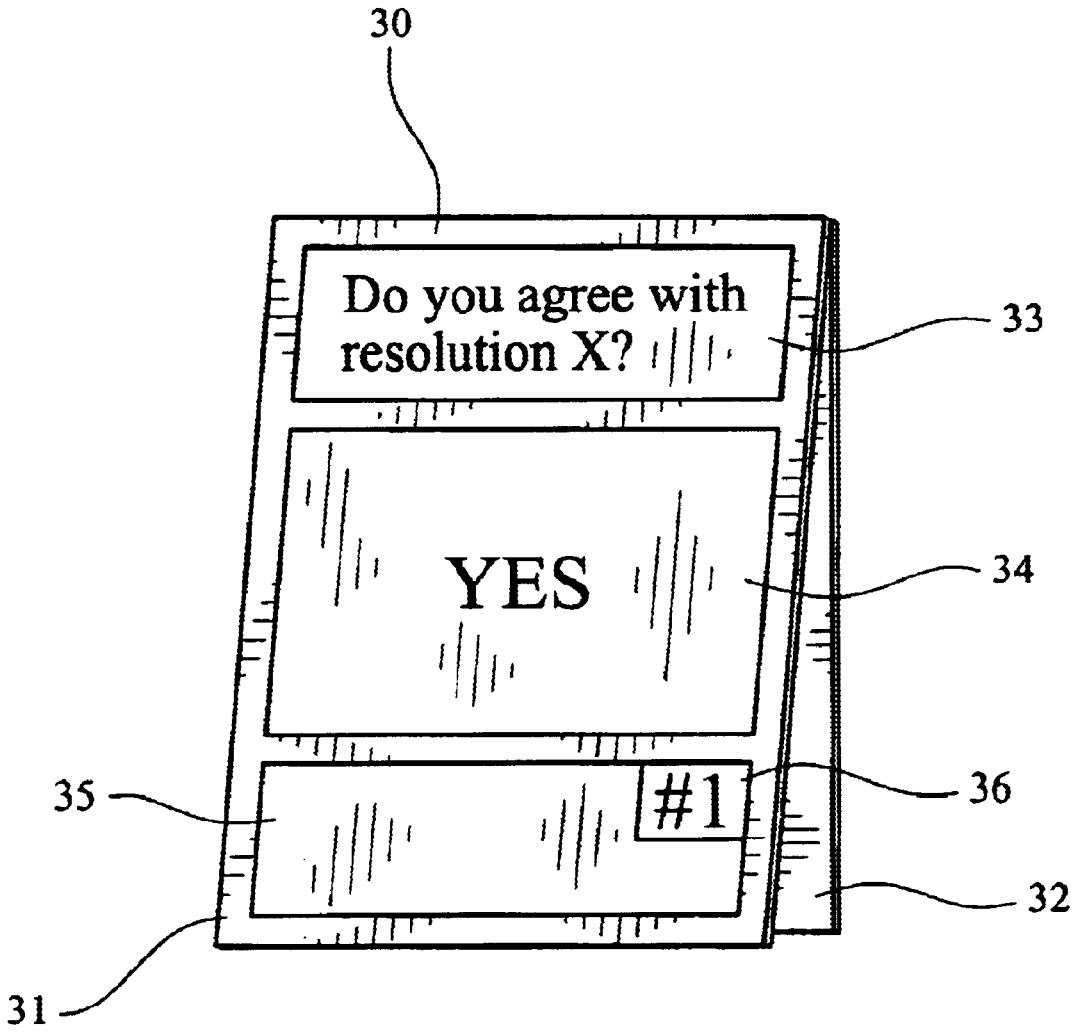
FIG. 2 is a plan view of a first embodiment of the ballot of the invention.
Figure 3:
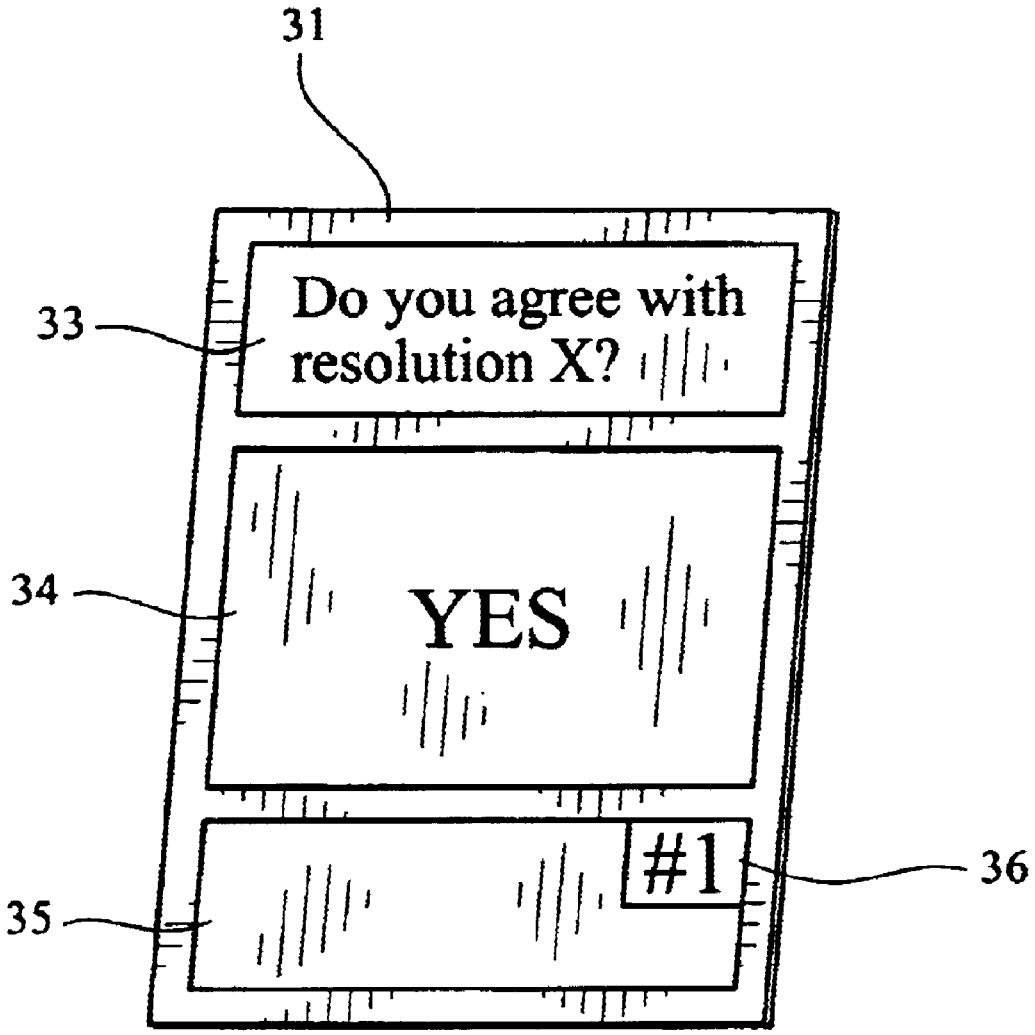
FIG. 3 is a plan view of the ballot of FIG. 2.

Several examples of suitable ballots are shown in the attached drawings. Referring to FIG. 2, in one embodiment, the ballot 30 has multiple pages, namely primary ballot 31 and secondary ballot 32.

Further referring to FIG. 2, primary ballot 31 and secondary ballot 32 have an issue portion 33 for stating a voting issue, a voting portion 34 for the voter to indicate a voting selection, and a unique identifying area 36.

Figure 6:
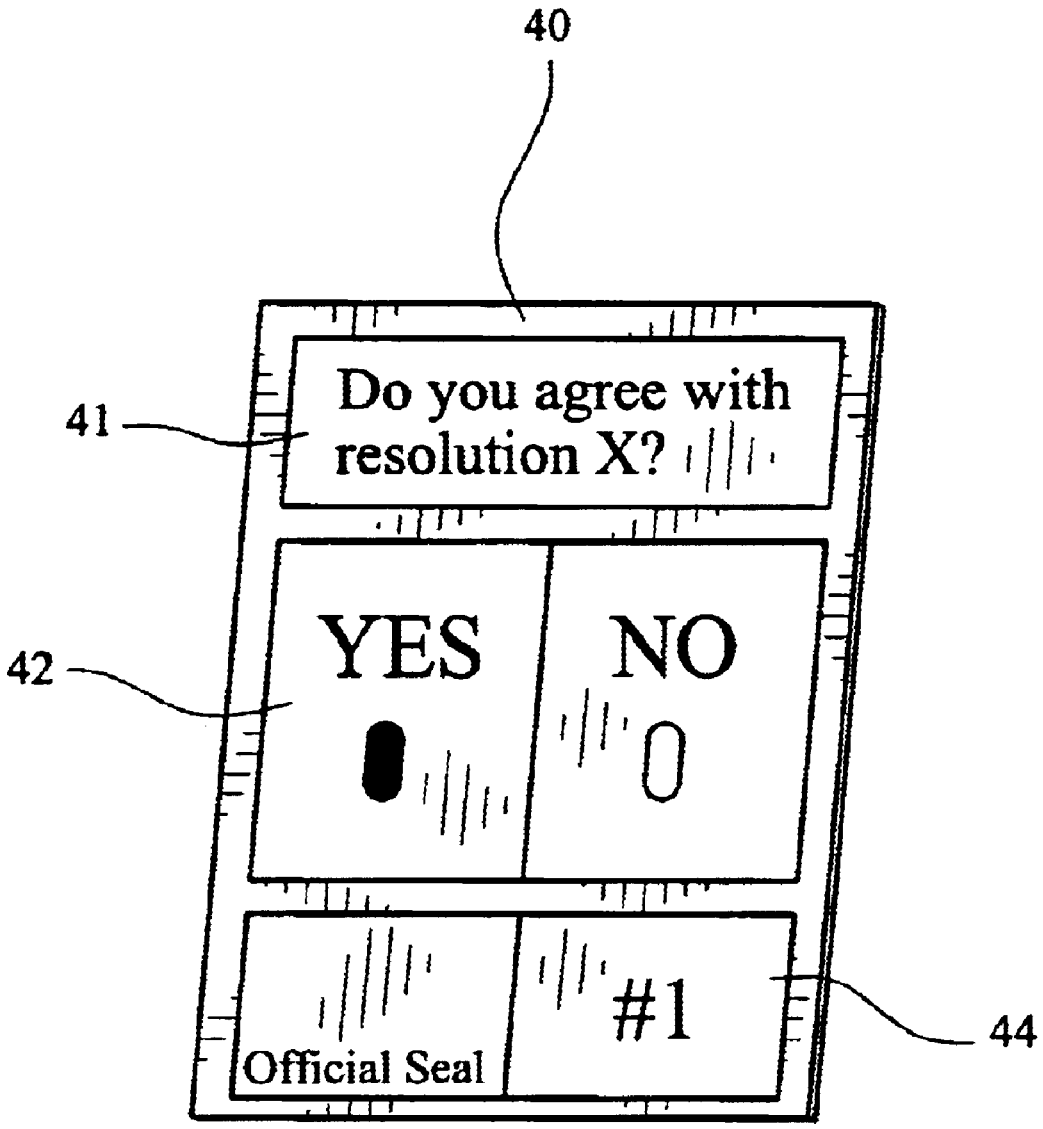
FIG. 6 is a plan view of a second embodiment of the ballot of the invention.

Reffering to FIG. 6, in a second embodiment of the ballot of the invention shown, with ballot 40 having an issue portion 41, voting potion 42, and ballot identifying portion 44. In issue portion 41 the issue is presented to the voter. In selection portion 42 a voter will make a voting selection indicative of the voter's response to the issue presented in issue portion 41. Referring to FIG. 6, a voter's response in voting area 42 is made in such a manner as to be optically scannable by a machine or a human in a conventional manner.

Figure 7:
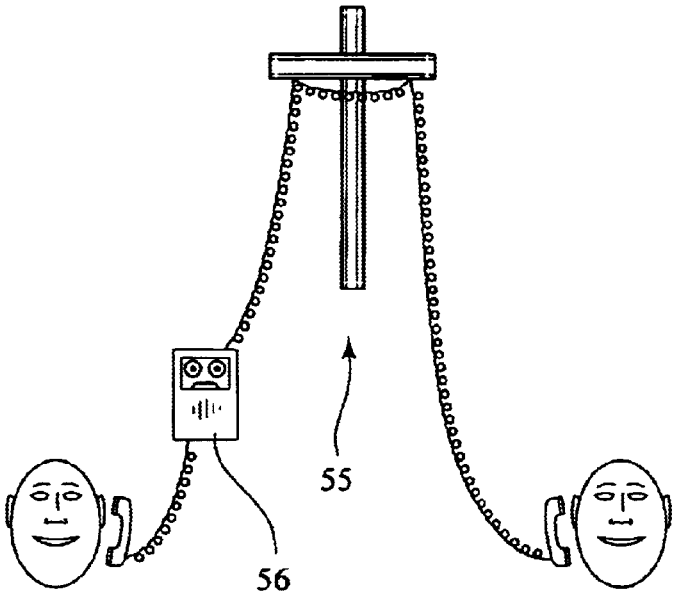
FIG. 7 is a view of the third embodiment of the ballot of the invention.
Figure 7:
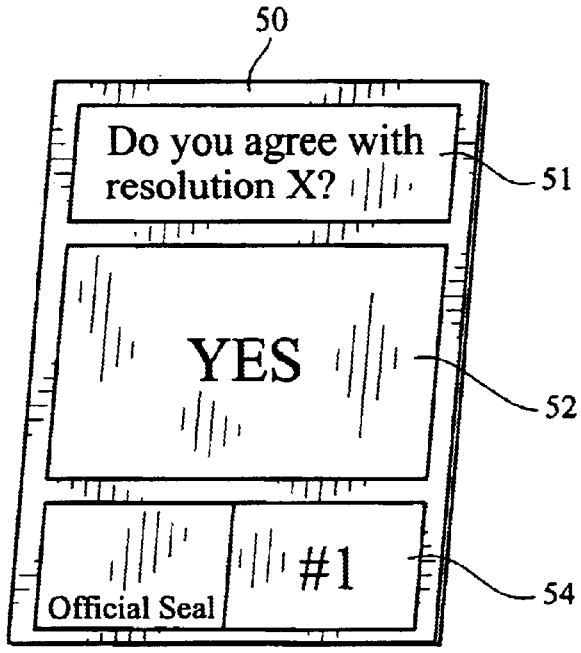

Referring to FIG. 7, the third embodiment of the ballot of the invention shows that a voter indicates voting results telephonically to an election official through a conventional telephone call 55 and using an in-line recording apparatus 56 such as an answering machine having recording capabilities as the primary ballot means.

Step 2—Retaining a Record From Each Voter's Voted Ballot

Referring to FIG. 2, once the ballot has been voted by the voter, the election official either receives and records the simultaneously-made secondary ballot 32 from the voter, either in person, by mail, by telephone, or by computer connection, or referring to FIG. 6 retains and records an equivalent copy of the information 40–44 as a secondary ballot 40.

Step 3—Publishing Each of the Ballot Records

After all the ballots from the voters have been recorded, the election official makes a copy of all the ballots available for public inspection.

Step 4—Validating the Ballot Records Published

After a suitable time of public availability, the election official validates the published record of the ballots from all the voters in a manner approved by the election rules.

If a voter disagrees that the published copy of their individual ballot is valid, the voter then provides verification to the election official by producing the voter's primary ballot to the election official. If the primary ballot proves the published copy invalid, the election official then makes a correction to the published copy.

If corrections are made to the published copy of all the ballots during the time of public availability, the corrected copy is published as the validated copy of all the ballots.

Step 5—Tabulating Votes From the Validated Ballot Records

Figure 4:
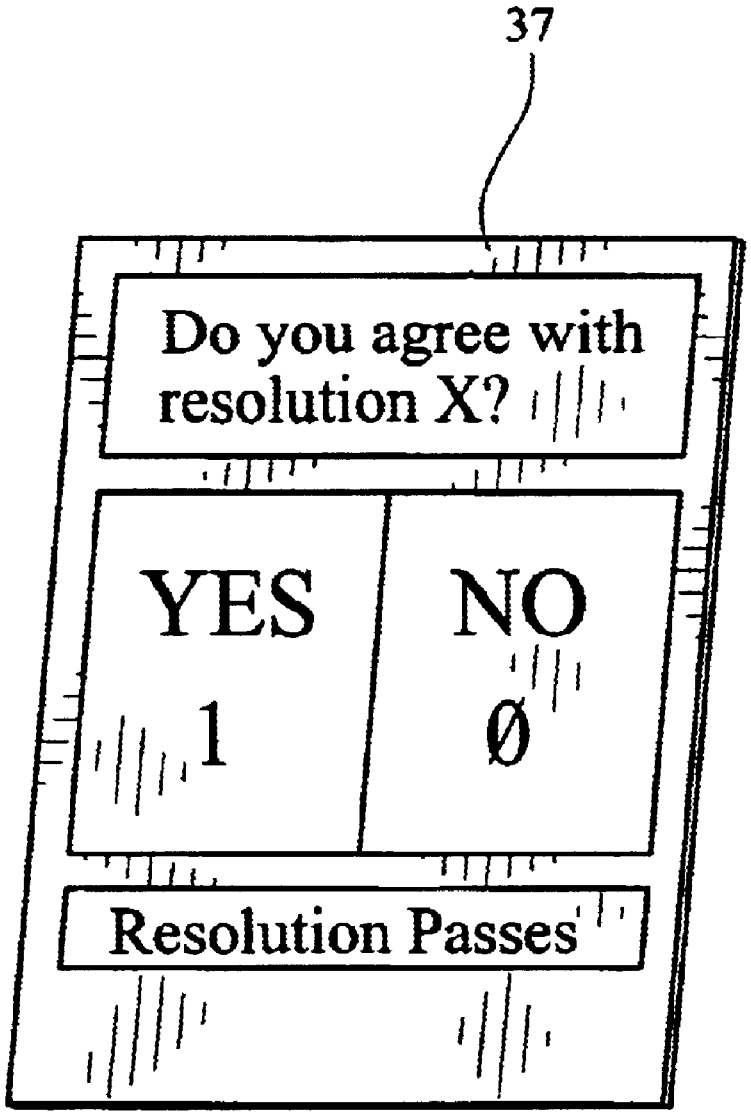
FIG. 4 is a plan view of the ballot tabulation document that results from the ballot of FIGS. 2 and 3.

Referring to FIG. 4, after the published copy of all the ballots is validated, the election official tabulates the ballots from it and records the tabulated results on a tabulation document 37.

Step 6—Certifying the Tabulation Results

Figure 5:
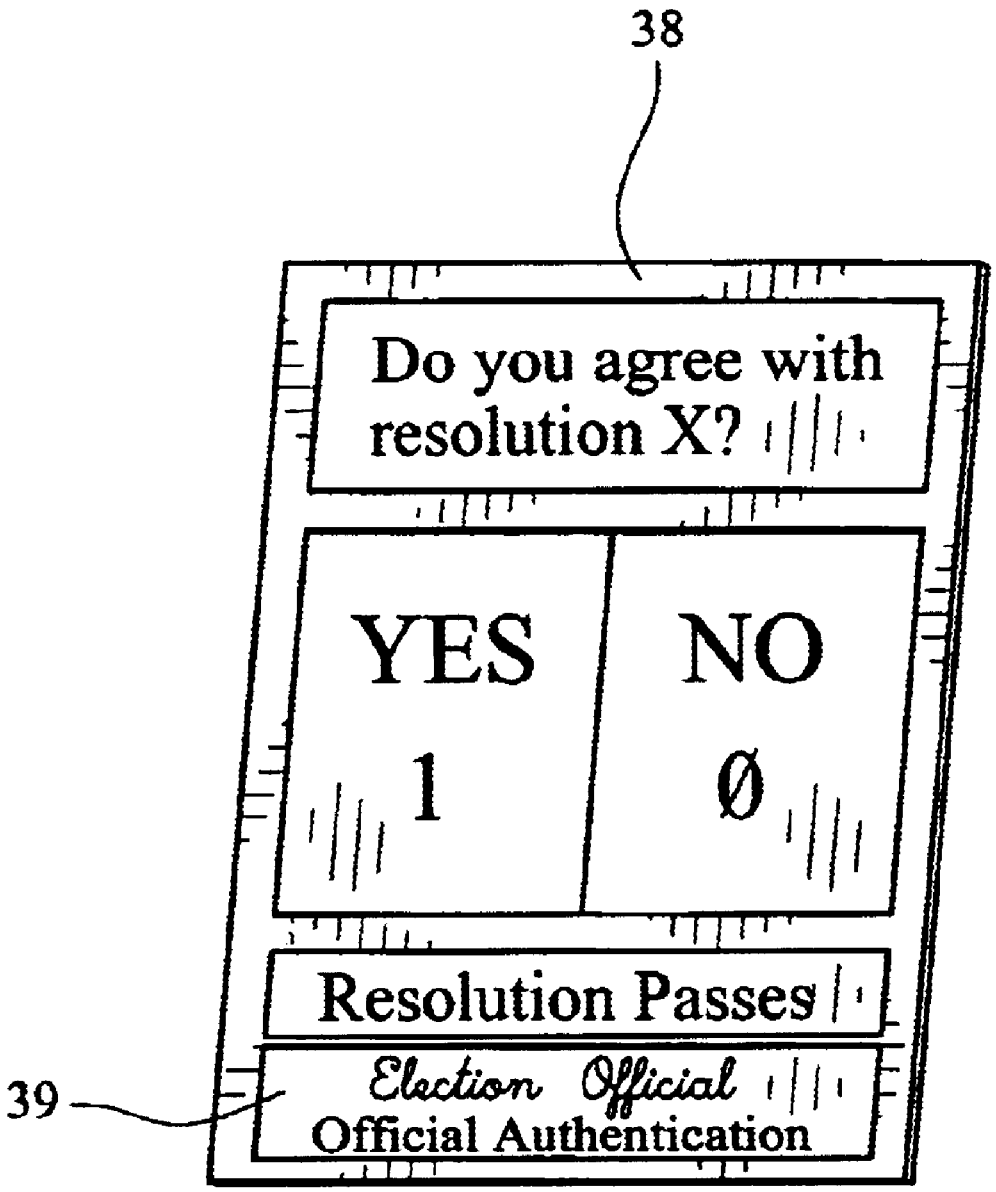
FIG. 5 is a plan view of the certified tabulation results from the tabulation document of FIG. 4.

Referring to FIG. 5, once the tabulation document 38 is created, the election official makes the tabulation document available for public. After a suitable period of time of public availability, the election official certifies the election 39 in the manner approved by the election rules applicable in each case.

If any voter wishes to contest the published results, the voter may request a recount of all ballots on the validated published record. If the recount by the election official produces a different result during the time of public availability, the correct tabulation result is published as the certified result.

The above-discussed method and system for conducting an election will likely be subject to election rules or regulations for holding the election in the jurisdiction where the election is held. Any variance from the steps in the method due to such rules or regulations are not claimed herein, though local rules and regulations may affect the mechanics of the election as such.

Thus, although there have been described particular embodiments of the present invention of a new and useful "Method and System of Voting", it is not intended that such references be construed as limitations upon the scope of this invention except as set forth in the following claims.

I claim:

1. A method of conducting an election among a plurality of voters, comprising:

(a) providing to a voter a primary ballot having a voting portion and a unique identification portion;

(b) the voter entering a response in the voting portion;

(c) creating a secondary ballot by making a copy of the primary ballot;

(d) returning the primary ballot to the voter;

(e) publishing all the secondary ballots recorded during voting;

(f) allowing each voter the opportunity to verify or correct the accuracy of the published secondary record with their primary ballot;

(g) validating the verified or corrected published secondary record;

(h) tabulating the votes from the validated published record;

(i) publishing the tabulation results from the validated record;

(j) allowing the voters the opportunity to verify or correct the accuracy of the tabulation results from the validated record; and (k) certifying the results of the verified or corrected tabulation results.

2. The method of claim 1, wherein the primary ballot is marked with at least one unique identifying symbol for distinguishing the primary ballot.

3. The method of claim 1, wherein the secondary ballot is marked with at least one unique identifying symbol for distinguishing the secondary ballot.

4. The method of claim 1, wherein the primary ballot and the secondary ballot are marked with the same at least one unique identifying symbol for correlating the primary ballot and secondary ballot.

5. The method of claim 1, wherein the executing step further comprises the voter simultaneously voting on the primary ballot and making multiple secondary ballot copies.

6. The method of claim 1, further comprising the step of the voter demonstrating to the election official that the published secondary ballot and the primary ballot are not identical, and the election official correcting the published secondary ballot.

7. The method of claim 1, further comprising the step of the voter demonstrating to the election official that the published tabulated vote is not accurate, and the election official replacing the tabulated vote with a corrected published tabulated vote.

8. An election method for receiving individually and commonly verifiable voting results from a voting group, comprising the steps of:

(a) providing an unvoted primary ballot to a voter from the voting group;

(b) allowing the voter to simultaneously record a vote on the unvoted primary ballot and on a secondary ballot record;

(c) returning the voted primary ballot to the voter;

(d) receiving the secondary ballot record from the voter;

(e) publishing the secondary ballots records received from all the voters;

(f) allowing the voter to determine the accuracy of the published secondary ballot records;

(g) validating the published secondary ballot records;

(h) publishing the validated ballot records;

(i) tabulating the results of from the validated ballot records;

(j) publishing the tabulated results;

(k) allowing the voter to determine the accuracy of the tabulated results; and (l) certifying the tabulated results.

9. The method of claim 8, wherein the unvoted primary ballot and the secondary ballot record are marked with identical unique identifying indicia for correlating the unvoted primary ballot and the secondary ballot record.

10. The method of claim 8, further comprising the step of the voter demonstrating to the election official that the published secondary ballot and the voter's primary ballot are not identical, and the election official correcting the published secondary ballot record prior to validating the published secondary ballot record.

11. The method of claim 8, further comprising the step of a voter demonstrating to the election official that published tabulated result is not correct, and the election official correcting the published tabulated result prior to certifying the tabulated results.

12. An election method for receiving individually and commonly verifiable voting results from each voter in a voting group, comprising the steps of:

(a) creating telephonic contact between a voter and an election official;

(b) the voter initiating audio recording equipment sufficient to make an audio record of the telephonic contact to be retained as the primary ballot;

(c) the election official dispensing a voting issue to the voter for voting;

(d) the election official receiving a vote on the voting issue from the voter;

(e) the election official entering the vote from the voter on a secondary ballot record;

(f) the election official retaining the secondary ballot record;

(g) the election official publishing all the secondary ballot records;

(h) allowing the voter the opportunity to verify the accuracy of the published secondary ballot records;

(i) validating the published ballot records;

(j) publishing the validated ballot records;

(k) tabulating the results of the validated ballot records;

(l) publishing the tabulated results of the validated ballot records;

(m) allowing the voters the opportunity to verify the accuracy of the published tabulated results; and (n) certifying the published tabulated results.

13. The method of claim 12, further comprising the step of the voter demonstrating to the election official that the published secondary ballot record is not identical to the primary ballot of the telephonic contact.

14. The method of claim 12, further comprising the step of the election official correcting the published secondary ballot record upon confirming that the published secondary ballot and the primary record of the telephonic contact are not identical, and prior to validating the published secondary ballot records.

15. The method of claim 12, further comprising the step of the voter demonstrating to the election official that the published tabulated result is not correct, and the election official correcting the published tabulated result prior to certifying the tabulated results.

* * * * *

UNITED STATES PATENT AND TRADEMARK OFFICE

CERTIFICATE OF CORRECTION

PATENT NO. : 6,726,090 B1
DATED : April 27, 2004
INVENTOR(S) : David Kargel

It is certified that error appears in the above-identified patent and that said Letters Patent is hereby corrected as shown below:

Column 6,
Line 11, add the word -- record -- so line reads: "published secondary ballot record and the voter's primary ballot are"
Line 55, add the word -- ballot -- so line reads: "ballot and the primary ballot record of the telephonic contact are"

Signed and Sealed this

Nineteenth Day of April, 2005

JON W. DUDAS
*Director of the United States Patent and Trademark Office*